US010556425B2

(12) United States Patent
Okazaki

(10) Patent No.: US 10,556,425 B2
(45) Date of Patent: Feb. 11, 2020

(54) LIQUID DISCHARGE DEVICE AND PRINTING APPARATUS

(71) Applicant: SEIKO EPSON CORPORATION, Tokyo (JP)

(72) Inventor: Shinya Okazaki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/993,067

(22) Filed: May 30, 2018

(65) Prior Publication Data

US 2018/0345660 A1 Dec. 6, 2018

(30) Foreign Application Priority Data

May 31, 2017 (JP) ..... 2017-107677

(51) Int. Cl.
*B41J 2/045* (2006.01)

(52) U.S. Cl.
CPC ..... *B41J 2/04541* (2013.01); *B41J 2/0455* (2013.01); *B41J 2/04581* (2013.01)

(58) Field of Classification Search
CPC ..... B41J 2/04541; B41J 2/04548
See application file for complete search history.

(56) References Cited

U.S. PATENT DOCUMENTS

2015/0273821 A1* 10/2015 Abe ..... B41J 2/04541 347/10
2016/0167372 A1 6/2016 Yamada

FOREIGN PATENT DOCUMENTS

| | | | |
|---|---|---|---|
| CN | 105691000 | A | 6/2016 |
| JP | 03-169283 | A | 7/1991 |
| JP | 05-244789 | A | 9/1993 |
| JP | 10-146971 | A | 6/1998 |

* cited by examiner

*Primary Examiner* — Julian D Huffman
(74) *Attorney, Agent, or Firm* — Foley & Lardner LLP

(57) ABSTRACT

There is provided a liquid discharge device including: a printing head; and a head driving circuit that is connected to the printing head via an FFC and outputs a driving signal, in which the driving circuit includes a signal output unit which outputs an analog signal, a transistor pair which is connected to the signal output unit and the FFC and driven with the analog signal output from the signal output unit to output the driving signal to the FFC, a return path which is connected to the FFC and feeds back the driving signal output from the transistor pair to the signal output unit, and an oscillation suppression unit which suppresses oscillation of input from the return path to the signal output unit.

4 Claims, 6 Drawing Sheets

LIQUID DISCHARGE DEVICE AND PRINTING APPARATUS

CROSS REFERENCES TO RELATED APPLICATIONS

The present invention contains subject matter related to Japanese Patent Application No. 2017-107677 filed in the Japanese Patent Office on May 31, 2017, the entire contents of which are incorporated herein by reference.

BACKGROUND

1. Technical Field

The invention relates to a liquid discharge device and a printing apparatus.

2. Related Art

In the related art, a liquid discharge device includes a driving element that discharges a liquid from a nozzle, and controls driving the driving element by a driving signal output from a driving circuit (see, for example, see JP-A-10-146971).

JP-A-10-146971 discloses a driving circuit of a printer head that discharges ink from a nozzle by driving a piezo element as a driving element with a trapezoidal wave pulse voltage.

Although the connection between the driving circuit and the driving element is performed by a cable, in a case of feedback control of the driving signal, there is a possibility that the driving signal fed back to the driving circuit oscillates, under influence of resonance caused by parasitic capacitance of the cable and parasitic inductance. Particularly, there is a problem that the influence of resonance becomes conspicuous as the length of the cable connecting the liquid discharge head and the driving circuit becomes longer.

SUMMARY

An advantage of some aspects of the invention is to stably operate a liquid discharge device by reducing the influence of resonance generating in a cable.

According to an application example of the invention, there is provided a liquid discharge device including: a liquid discharge head that has a nozzle which discharges liquid and a driving element which is provided corresponding to the nozzle and discharges the liquid by pressurizing the liquid according to a driving signal; and a driving circuit that is connected to the liquid discharge head via a cable and outputs the driving signal, in which the driving circuit includes a signal output unit which outputs an analog signal, a transistor pair which is connected to the signal output unit and the cable and driven with the analog signal output from the signal output unit to output the driving signal to the cable, a feedback loop which is connected to the cable and feeds back the driving signal output from the transistor pair to the signal output unit, and an oscillation suppression unit which suppresses oscillation of input from the feedback loop to the signal output unit.

According to the configuration, oscillation of input from the feedback loop to the signal output unit is suppressed by the oscillation suppression unit. Therefore, it is possible to reduce the influence of resonance generating in the cable and stably operate the liquid discharge device.

In addition, in the liquid discharge device, the feedback loop may include a filter, as the oscillation suppression unit, disposed between the cable and the signal output unit.

According to the configuration, oscillation of the input from the feedback loop to the signal output unit is suppressed by the filter. Therefore, the oscillation of the input to the signal output unit with a simple configuration can be suppressed.

In addition, in the liquid discharge device, the filter may attenuate frequency components corresponding to the inductance and capacitance of the cable.

According to the configuration, the frequency component corresponding to the inductance and capacitance of the cable can be attenuated by the filter. Therefore, it is possible to more effectively reduce the influence of the resonance generating in the cable and to stably operate the liquid discharge device.

In addition, in the liquid discharge device, the oscillation suppression unit may include an inductive element connected between the cable and the feedback loop.

According to the configuration, oscillation of the input to the signal output unit is suppressed by the inductive element. Therefore, it is possible to suppress the oscillation of the input to the signal output unit with a simple configuration.

In addition, according to an application example of the invention, there is provided a printing apparatus including: a printing head that has a nozzle which discharges ink and a driving element which is provided corresponding to the nozzle and discharges the ink by pressurizing the ink according to a driving signal; and a driving circuit that is connected to the printing head via a cable and outputs the driving signal, in which the driving circuit includes a signal output unit which outputs an analog signal, a transistor pair which is connected to the signal output unit and the cable and driven with the analog signal output from the signal output unit to output the driving signal to the cable, a feedback loop which is connected to the cable and feeds back the driving signal output from the transistor pair to the signal output unit, and an oscillation suppression unit which suppresses oscillation of input from the feedback loop to the signal output unit.

According to the configuration, oscillation of input from the feedback loop to the signal output unit is suppressed by the oscillation suppression unit. Therefore, it is possible to reduce the influence of resonance generating in the cable and stably operate the liquid discharge device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Embodiments of the invention will be described below with reference to the accompanying drawings.

Figure 1:
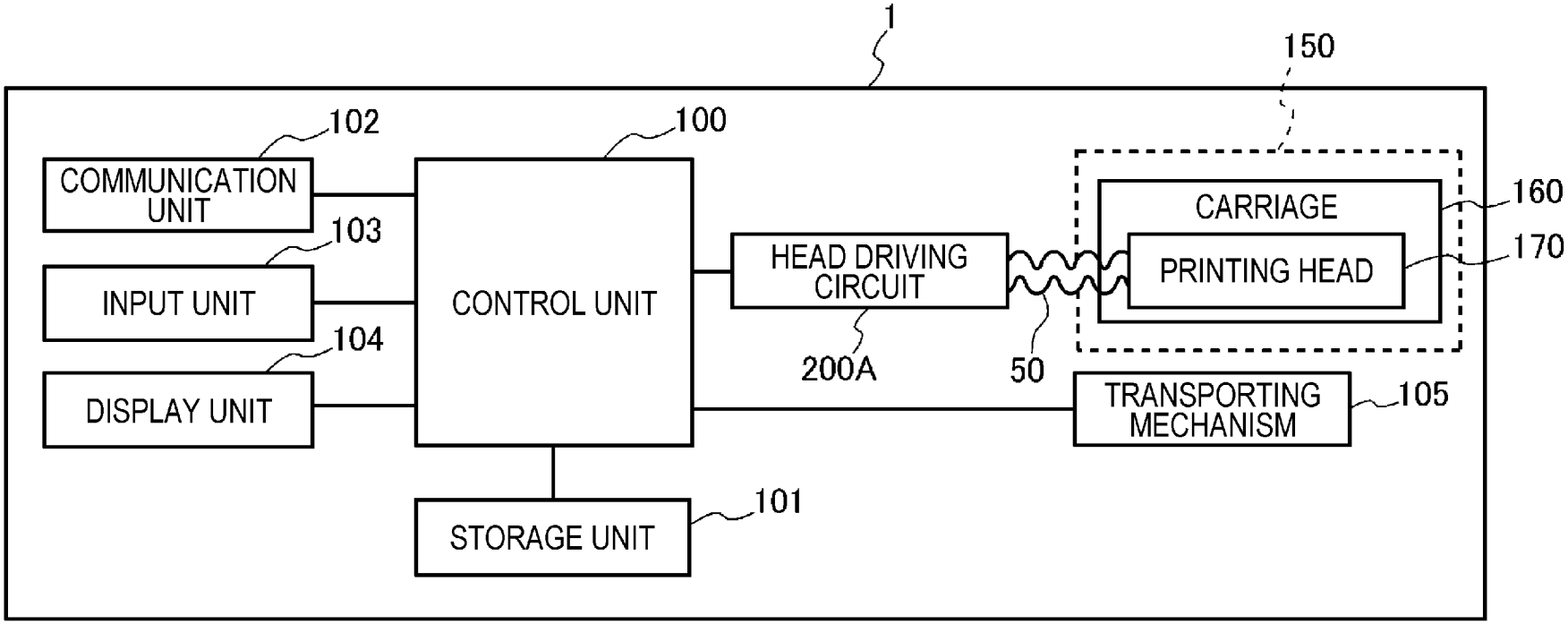
FIG. 1 is a configuration diagram illustrating a configuration of a printing apparatus.

FIG. 1 is a configuration diagram illustrating a configuration of the printing apparatus 1.

The printing apparatus 1 forms ink dot groups on a printing medium by discharging ink based on printing data supplied from an external host computer (not illustrated). Accordingly, images (including letters, symbols, figures, or the like) corresponding to the printing data are printed on the printing medium. The ink corresponds to "liquid" of the invention.

The printing apparatus 1 includes a control unit 100, a storage unit 101, a communication unit 102, an input unit 103, a display unit 104, a transporting mechanism 105, a head driving circuit 200A, and a printing unit 150. The printing unit 150 includes a carriage 160 and a printing head 170 including a nozzle 175 (see FIG. 2).

The control unit 100 includes a CPU, a ROM, a RAM, an ASIC, a signal processing circuit, and the like (none of which are illustrated), and controls each unit of the printing apparatus 1. The control unit 100 executes processing by hardware and software. In detail, the control unit 100 reads a program stored in a ROM, a storage unit 101 (described below) or the like into the RAM and executes the processing by the CPU. In addition, the control unit 100 includes a processing circuit such as an ASIC and executes a process by a function implemented in the ASIC.

The control unit 100 communicates with a host computer connected by wire or wirelessly, and receives the printing data transmitted from the host computer. The received printing data is temporarily stored in the storage unit 101. In addition, the control unit 100 controls the driver circuit (not illustrated) to control the movement of the carriage 160 in the main-scanning direction and controls the transporting mechanism 105 to control transporting of the printing medium in the sub-scanning direction. Further, based on the printing data, the control unit 100 outputs a control signal for controlling the timing at which ink is discharged from the nozzle 175 and the amount of ink discharged to the head driving circuit 200A.

The storage unit 101 includes a hard disk, a nonvolatile memory such as an EEPROM and stores various data such as printing data in a rewritable manner.

Under the control of the control unit 100, the communication unit 102 communicates with an external device such as a host computer that controls the printing operation of the printing apparatus 1, for example, according to a predetermined communication standard.

The input unit 103 includes an operation switch and a touch panel and accepts an operation by a user. The input unit 103 detects a user operation on an operation switch or a touch panel and outputs a signal (referred to as an operation signal) corresponding to the detected operation to the control unit 100. The control unit 100 executes processing according to the input operation signal.

The display unit 104 includes a plurality of LEDs, a display panel, and the like. The display unit 104 turns on or turns off the LED under the control of the control unit 100 and displays information on the display panel under the control of the control unit 100.

The transporting mechanism 105 includes a transporting roller pair, a transporting motor (none of which is illustrated), and the like and transports the printing medium along the transporting path under the control of the control unit 100. In this embodiment, a case where the printing medium is roll paper will be described. The printing apparatus 1 is provided with a transporting path extending from a storage unit in which roll paper is stored to a paper discharge opening (not illustrated) via a printing position by the printing head 170.

The head driving circuit 200A drives the printing head 170 according to the control of the control unit 100.

A control signal is input from the control unit 100 to the head driving circuit 200A. The head driving circuit 200A generates a driving signal for controlling the discharge amount and discharge timing of ink discharged from each nozzle 175 of the printing head 170 based on the input control signal, and outputs the driving signal to the printing head 170.

In addition, the head driving circuit 200A is connected to the printing head 170 via the flexible flat cable 50. In other words, the head driving circuit 200A outputs a driving signal to the printing head 170 via the flexible flat cable 50. The flexible flat cable 50 will be referred to as FFC 50 hereinafter. The FFC 50 corresponds to the "cable" of the invention.

The printing unit 150 includes a carriage 160. A printing head 170 having a plurality of nozzles 175 for discharging ink is provided on the carriage 160. The carriage 160 is driven by a motor and configured to be movable in the main-scanning direction which is the width direction of the roll paper.

While reciprocating the carriage 160 in the main-scanning direction, the printing unit 150 ejects ink supplied from an ink tank (not illustrated) by the printing head 170, and prints an image such as characters, symbols, and drawings on the roll paper transported to the printing position. The printing head 170 corresponds to the "liquid discharge head" of the invention.

Figure 2:
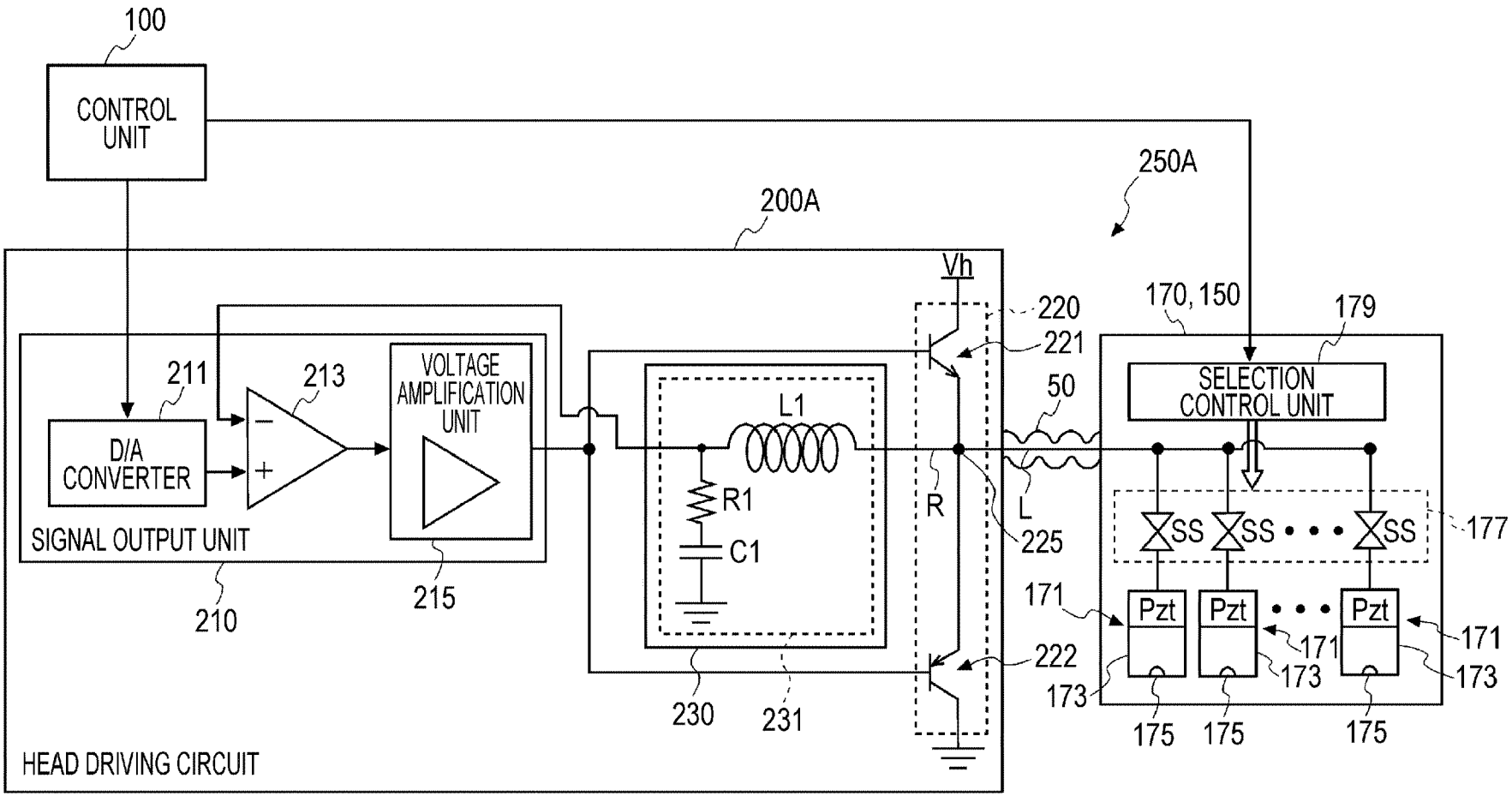
FIG. 2 is a configuration diagram illustrating a configuration of a head driving circuit and a printing unit according to a first embodiment.

FIG. 2 is a configuration diagram illustrating the configuration of the head driving circuit 200A and the printing unit 150. The head driving circuit 200A and the printing unit 150 operate as the liquid discharge device 250A of the first embodiment. The head driving circuit 200A includes a signal output unit (signal output circuit) 210, a transistor pair 220, and an oscillation suppression unit 230.

The signal output unit 210 includes a D/A converter 211, an operational amplifier 213, and a voltage amplification unit 215.

The D/A converter 211 is connected to the control unit 100, and is input a digital control signal from the control unit 100. The D/A converter 211 converts the input digital control signal into an analog signal. The D/A converter 211 outputs the converted analog signal to the operational amplifier 213.

The analog signal output from the D/A converter 211 is input to the non-inverting input terminal of the operational amplifier 213. In addition, a signal (hereinafter referred to as a return signal) obtained by returning a driving signal via a return path R is input to the inverting input terminal of the operational amplifier 213. The return path R constitutes a portion of a feedback loop that returns the driving signal to the signal output unit 210.

The operational amplifier 213 integrates the voltage of the inverting input terminal and outputs a signal indicating the voltage difference obtained by subtracting the voltage integrated of the inverting input terminal from the voltage of the analog signal input to the non-inverting input terminal to the voltage amplification unit 215.

The voltage amplification unit 215 includes an amplifier and amplifies the analog signal output from the operational amplifier 213 with a predetermined amplification factor. The voltage amplification unit 215 outputs the amplified analog signal to the transistor pair 220.

Although FIG. 2 illustrates a configuration in which the output of the voltage amplification unit 215 is directly input to the transistor pair 220, a gate driver for driving the gate of the transistor pair 220 may be provided between the voltage amplification unit 215 and the transistor pair 220. In other words, a signal output from the voltage amplification unit 215 may input to the gate driver, and the gate driver may drive the transistors 221 and 222 constituting the transistor pair 220 based on the input signal.

The transistor pair 220 is configured by complementarily connecting an NPN type bipolar transistor (hereinafter referred to as a charging transistor) 221 and a PNP type bipolar transistor (hereinafter referred to as a discharge transistor) 222.

The emitter of the charging transistor 221 and the emitter of the discharge transistor 222 are connected to a connection point 225. The connection point 225 serves as an output end of a driving signal, and a driving signal supply line L which is a signal line for supplying a driving signal to the printing head 170 is connected to the connection point 225. A portion of the driving signal supply line L is constituted by the FFC 50.

A voltage Vh (for example, 42 volts) is applied to a collector of the charging transistor 221. The collector of the discharge transistor 222 is grounded to the ground. In addition, an analog signal is input from the signal output unit 210 to a base of the charging transistor 221 and a base of the discharge transistor 222.

When the signal level of the analog signal output from the signal output unit 210 becomes high level and the base voltage of the charging transistor 221 becomes higher than the emitter voltage, the charging transistor 221 becomes a state of being turned on. When the charging transistor 221 becomes a state of being turned on, the voltage of the driving signal output to the driving signal supply line L rises.

When the voltage of the analog signal output from the signal output unit 210 becomes low level and the base voltage of the discharge transistor 222 becomes lower than the emitter voltage, the discharge transistor 222 becomes a state of being turned on. When the discharge transistor 222 becomes a state of being turned on, the voltage of the driving signal output to the driving signal supply line L drops.

When the voltage of the analog signal output from the signal output unit 210 becomes a voltage intermediate between the high level and the low level, both the charging transistor 221 and the discharge transistor 222 become states of being turned off.

The head driving circuit 200A has a return path R that returns the driving signal output to the printing head 170 to the operational amplifier 213 of the signal output unit 210. The return path R is provided with an oscillation suppression unit (oscillation suppression circuit) 230 for suppressing oscillation of a driving signal (return signal) input to the operational amplifier 213. The oscillation suppression unit 230 is provided between the FFC 50 and the signal output unit 210.

The oscillation suppression unit 230 includes a filter 231 that attenuates frequency components generated by parasitic capacitance and parasitic inductance generated in the FFC 50.

The filter 231 includes a coil L1, a capacitor C1, and a resistor R1. The coil L1, the capacitor C1, and the resistor R1 constitute an LPF (Low Pass Filter). In FIG. 2, although a generally known low-pass filter configured by the coil L1, the capacitor C1 and the resistor R1 is illustrated, the low pass filter is not limited to that illustrated in FIG. 2. As described below, it is sufficient to use a filter circuit capable of suppressing a frequency component near the resonance point of the LC resonance (near 5 MHz) configured in the FFC 50.

The printing head 170 includes an actuator unit 171, a switch unit 177, and a selection control unit 179.

The actuator unit 171 includes a plurality of nozzles 175 from which ink droplets are discharged. The plurality of nozzles 175 are formed on the surface of the printing head 170 facing the roll paper on which the image is printed. An ink chamber 173 is connected to each of the nozzles 175.

Ink from the ink tank is supplied to the ink chamber 173. In each of the ink chambers 173, a piezoelectric element Pzt is provided. The piezoelectric element Pzt corresponds to the "driving element" of the invention.

The piezoelectric element Pzt deforms when a voltage is applied and presses the corresponding ink chamber 173. When the ink chamber 173 is pressurized by the piezoelectric element Pzt, ink droplets are discharged from the nozzle 175. The amount of deformation of the piezoelectric element Pzt varies depending on the voltage value of the applied voltage. Therefore, by controlling voltage to be applied to the piezoelectric element Pzt and the timing of applying the voltage, it is possible to adjust the force for pressing the ink chamber 173 and the timing of pressurizing.

The switch unit 177 includes a plurality of switch elements SS provided corresponding to each piezoelectric element Pzt of the actuator unit 171.

One end of each switch element SS is connected to the driving signal supply line L, and the other end thereof is connected to the piezoelectric element Pzt.

In a case where the switch element SS is in the conduction state, the switch element SS outputs and applies the driving signal supplied from the driving signal supply line L to the corresponding piezoelectric element Pzt. In addition, in a case where the switch element SS is in the non-conduction state, the switch element SS does not output the driving signal supplied from the driving signal supply line L to the corresponding piezoelectric element Pzt.

Therefore, by selectively bringing the switch element SS into a conduction state, a driving signal is applied only to the piezoelectric element Pzt corresponding to the switch element SS in the conduction state, and ink droplets are discharged from the nozzle 175.

The switch unit 177 is connected to the selection control unit 179. The selection control unit 179 switches each switch element SS of the switch unit 177 to the conduction state or the non-conduction state under the control of the control unit 100.

The control unit 100 determines nozzles 175 that discharge ink droplets and the size of ink droplets to be discharged, based on printing data to be printed. In addition, the control unit 100 determines the waveform of the driving signal for discharging the ink droplets of the size according to the size of the discharged ink droplets. The control unit 100 outputs a control signal to the head driving circuit 200A so that the driving signal of the determined waveform is applied to the piezoelectric element Pzt. In addition, the control unit 100 outputs to the selection control unit 179 of a control signal that brings the state of the switch element SS corresponding to the determined piezoelectric element Pzt into a conduction state.

In the piezo method in which ink is discharged by expanding and contracting the ink chamber 173 by the voltage applied to the piezoelectric element Pzt, it is necessary to apply a trapezoidal driving signal having a constant rise time and fall time to the piezoelectric element Pzt. In addition, in the piezo method, a slew rate of about 10 V/μs is required to maintain the discharge characteristics of the ink satisfactorily. The slew rate is the rate of change (voltage change with respect to time) of the voltage of the trapezoidal driving signal. The ink discharge characteristics include, for example, whether or not ink is discharged from the nozzle 175 (discharging/non-discharging), landing precision of the ink discharged from the nozzle 175, a difference from an expected value of the amount of ink discharged from the nozzle 175, Which directly affect printing quality.

So as to satisfy the slew rate requirement, the voltage amplification unit 215 of the head driving circuit 200A needs to have excellent characteristics with respect to high frequencies.

However, even if an amplifier with a zero-cross frequency of 5 MHz or more is used so as to be able to handle a slew rate of about 10 V/μs, there is a case where the high-frequency characteristics of the amplifier deteriorates due to the influence of parasitic capacitance and parasitic inductance of the FFC 50. The zero crossing frequency is a frequency at which the gain crosses 0 dB. For example, in a case where an FFC 50 having a length of several meters or more is used as a cable connecting the head driving circuit 200A and the printing head 170, the parasitic capacitance and the parasitic inductance of the FFC 50 are increased, and it became a factor the high frequency characteristics of the amplifier are deteriorated. In other words, there is a case where that, when the length of the FFC 50 increases, the resonance point of the LC resonance formed by the parasitic capacitance and the parasitic inductance is formed on the low frequency side as compared with a case where the length of the FFC 50 is short, and due to the influence of the LC resonance, there is a case where the high-frequency characteristics of the amplifier deteriorates.

Figure 3:
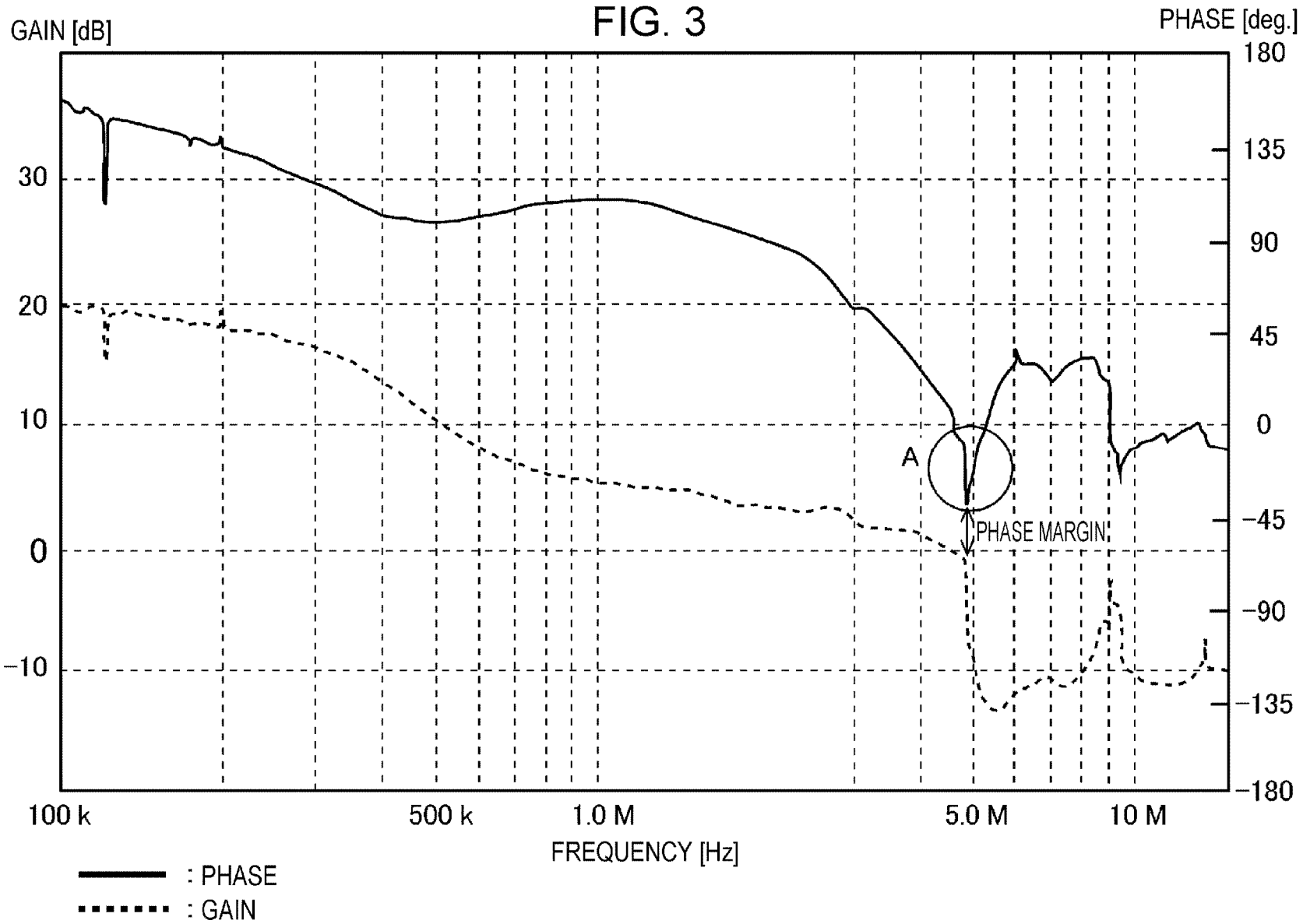
FIG. 3 is a diagram illustrating gain-phase characteristics of the head driving circuit of the related art.

FIG. 3 is a diagram illustrating an example of gain-phase characteristics of the head driving circuit of the related art.

The head driving circuit of the related art is a circuit in which the oscillation suppression unit 230 is not provided in the return path R which returns the driving signal to the signal output unit 210. In FIG. 3, the frequency characteristics of the phase is indicated by a solid line and the frequency characteristics of the gain are indicated by a broken line.

The frequency characteristic of the gain indicates the relationship between the voltage gain of the amplifier of the voltage amplification unit 215 and the frequency. In addition, the phase indicates the phase difference between the signal (analog signal) output from the voltage amplification unit 215 and the signal input to the voltage amplification unit 215, and the frequency characteristic of the phase indicates a relationship between the phase difference and the frequency thereof.

For example, in a case where the FFC 50 having a length of several meters is used as the FFC 50, the parasitic capacitance and the parasitic inductance of the FFC 50 increase. In the example illustrated in FIG. 3, due to the influence of the LC resonance formed by the parasitic capacitance and parasitic inductance of the FFC 50, the phase sharply changes near the range A (near 5 MHz), and there is a possibility that the phase is 0 degree in the region where the gain is 0 dB or more. In the gain-phase characteristics of the head driving circuit illustrated in FIG. 3, the phase margin in the region where the gain is 0 dB or more is only 8 degrees. In other words, there is no margin for 0 degree, and the head driving circuit becomes unstable circuit.

Figure 4:
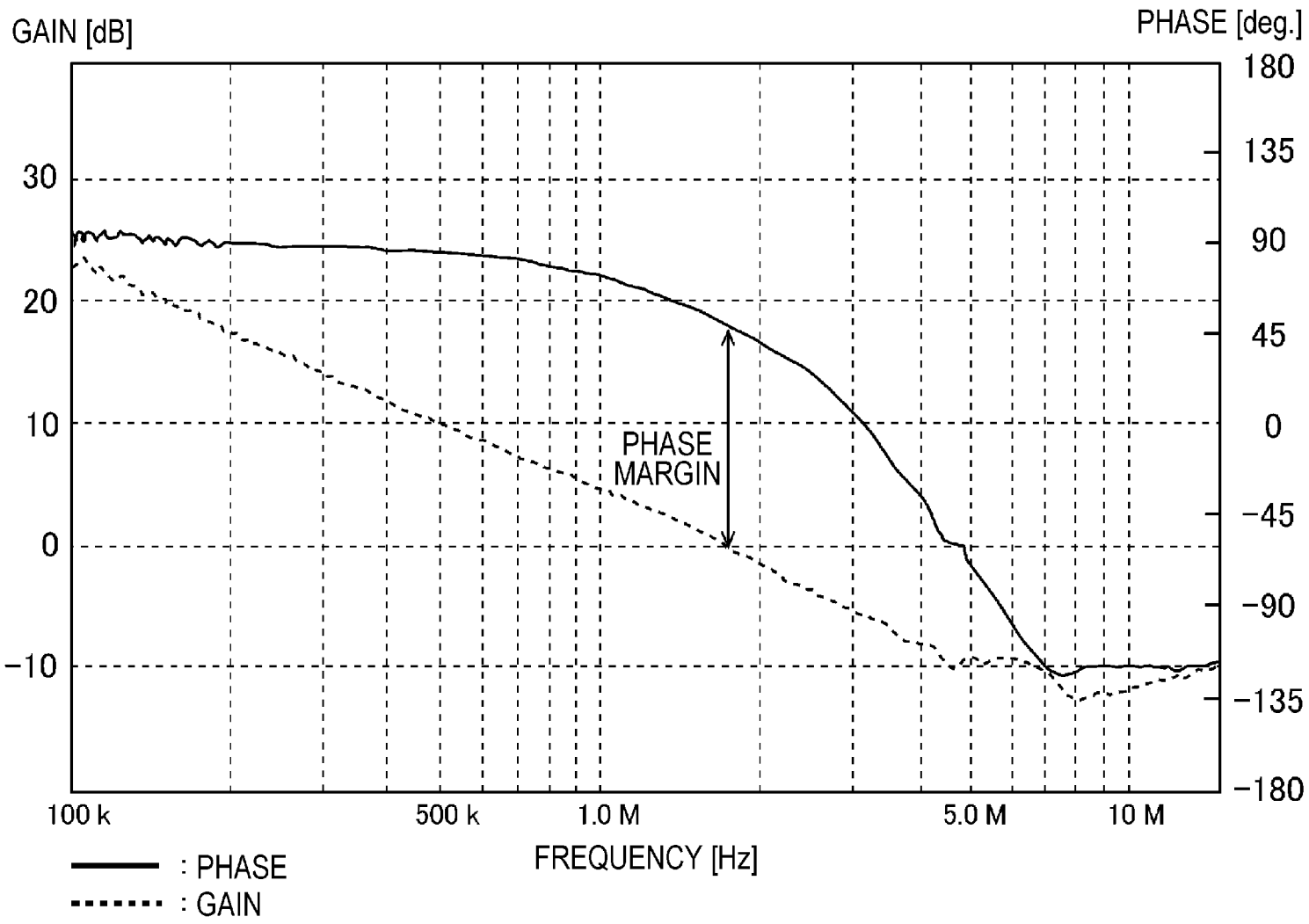
FIG. 4 is a diagram illustrating gain-phase characteristics in the head driving circuit of the first embodiment.

FIG. 4 is a diagram illustrating the gain-phase characteristics of the head driving circuit 200A of this embodiment, in which the frequency characteristic of the phase is indicated by a solid line and the frequency characteristic of the gain is indicated by a broken line.

As described above, the head driving circuit 200A of this embodiment has the return path R constituting a portion of the feedback loop, and the filter 231 as the oscillation suppression unit 230 is provided between the FFC 50 and the signal output unit 210.

The filter 231 suppresses frequency components in near the resonance point of LC resonance (near 5 MHz) configured in the FFC 50, among the return signals fed back to the operational amplifier 213. This makes it possible to suppress a sharp change in the phase and secure a phase margin in which the operation of the head driving circuit 200A does not become unstable.

As described above, the liquid discharge device 250A of the first embodiment includes the printing head 170 and the head driving circuit 200A connected to the printing head 170 via the FFC 50.

The printing head 170 includes a nozzle 175 that discharges ink, and a piezoelectric element Pzt that is provided corresponding to the nozzle 175 and that discharges ink by pressurizing the ink according to a driving signal.

In addition, the head driving circuit 200A includes a signal output unit 210, a transistor pair 220, and a return path R. The signal output unit 210 outputs an analog signal. The transistor pair 220 is connected to the signal output unit 210 and the FFC 50, and is driven with the analog signal output from the signal output unit 210 to output a driving signal to the cable. The return path R is connected to the FFC 50 and feeds back the driving signal output from the transistor pair 220 to the signal output unit 210.

In addition, the liquid discharge device 250A includes an oscillation suppression unit 230 that suppresses oscillation of an input from the return path R to the signal output unit 210. Therefore, it is possible to reduce the influence of the resonance generating in the FFC 50 and stably operate the liquid discharge device 250A.

In addition, the liquid discharge device 250A includes a filter 231 as an oscillation suppression unit 230 disposed between the FFC 50 and the signal output unit 210 in the return path R.

Therefore, it is possible to suppress the oscillation of the input to the signal output unit 210 with a simple configuration.

In addition, the filter 231 is a low-pass filter that attenuates frequency components corresponding to the inductance and capacitance of the FFC 50. Therefore, it is possible to more effectively reduce the influence of resonance generating in the FFC 50, and to stably operate the liquid discharge device.

Second Embodiment

Figure 5:
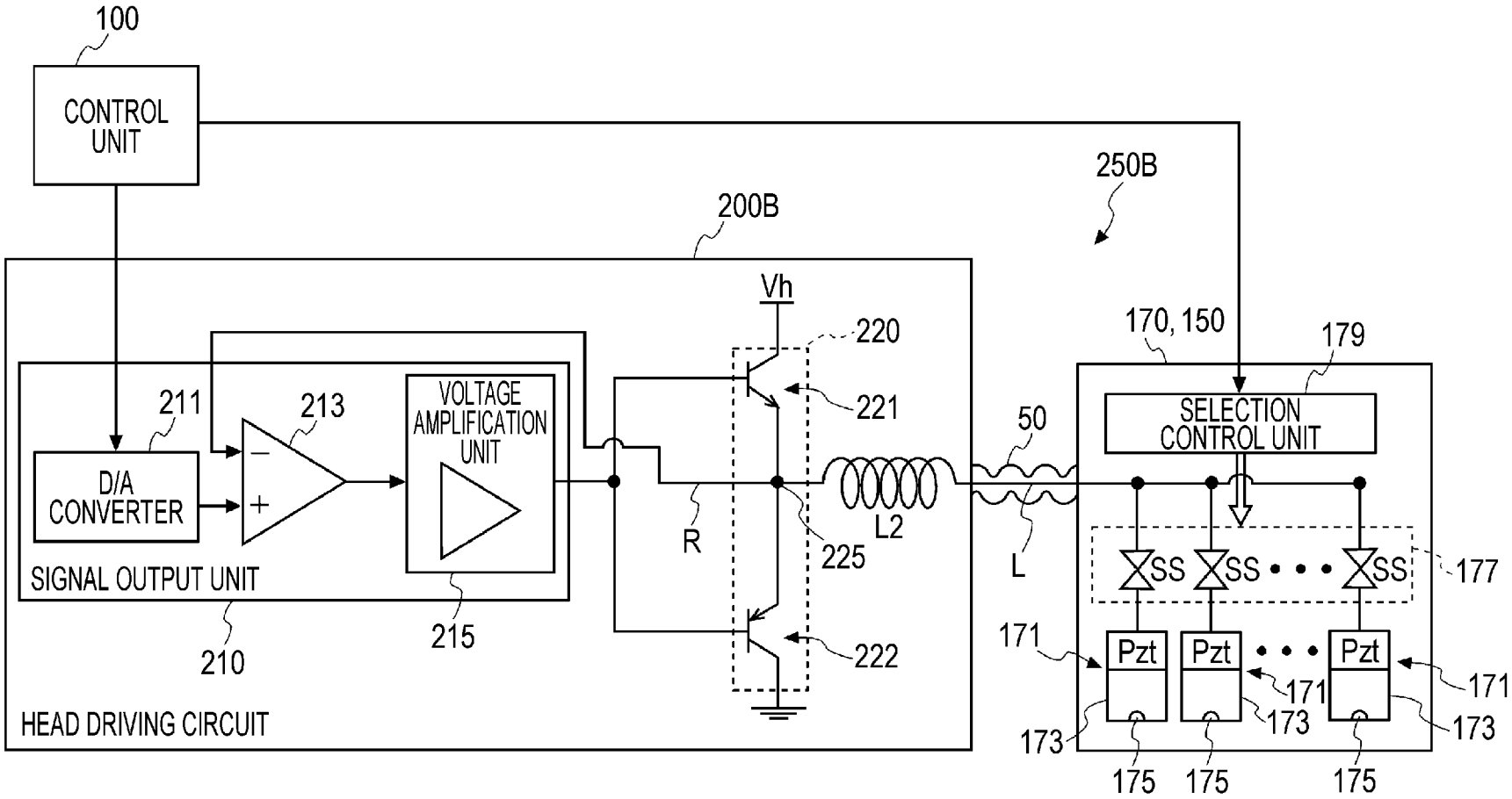
FIG. 5 is a configuration diagram illustrating a configuration of a head driving circuit and a printing unit of a second embodiment.

FIG. 5 is a configuration diagram illustrating the configuration of the head driving circuit 200B and the printing unit 150 according to the second embodiment. The head driving circuit 200B and the printing unit 150 operate as the liquid discharge device 250B of the second embodiment. In the second embodiment, the same components as those of the first embodiment described above are denoted by the same reference numerals, and description thereof is omitted.

The head driving circuit 200B of the second embodiment has a configuration in which the coil L2 is inserted in series with the driving signal supply line L. The coil L2 as the inductive element has low impedance for low-frequency components of the signal and high impedance for high-frequency components. Therefore, by inserting the coil L2 in series with the driving signal supply line L, the superimposition of the high-frequency component on the return signal returned to the inverting input terminal of the operational amplifier 213 via the return path R can be suppressed.

Figure 6:
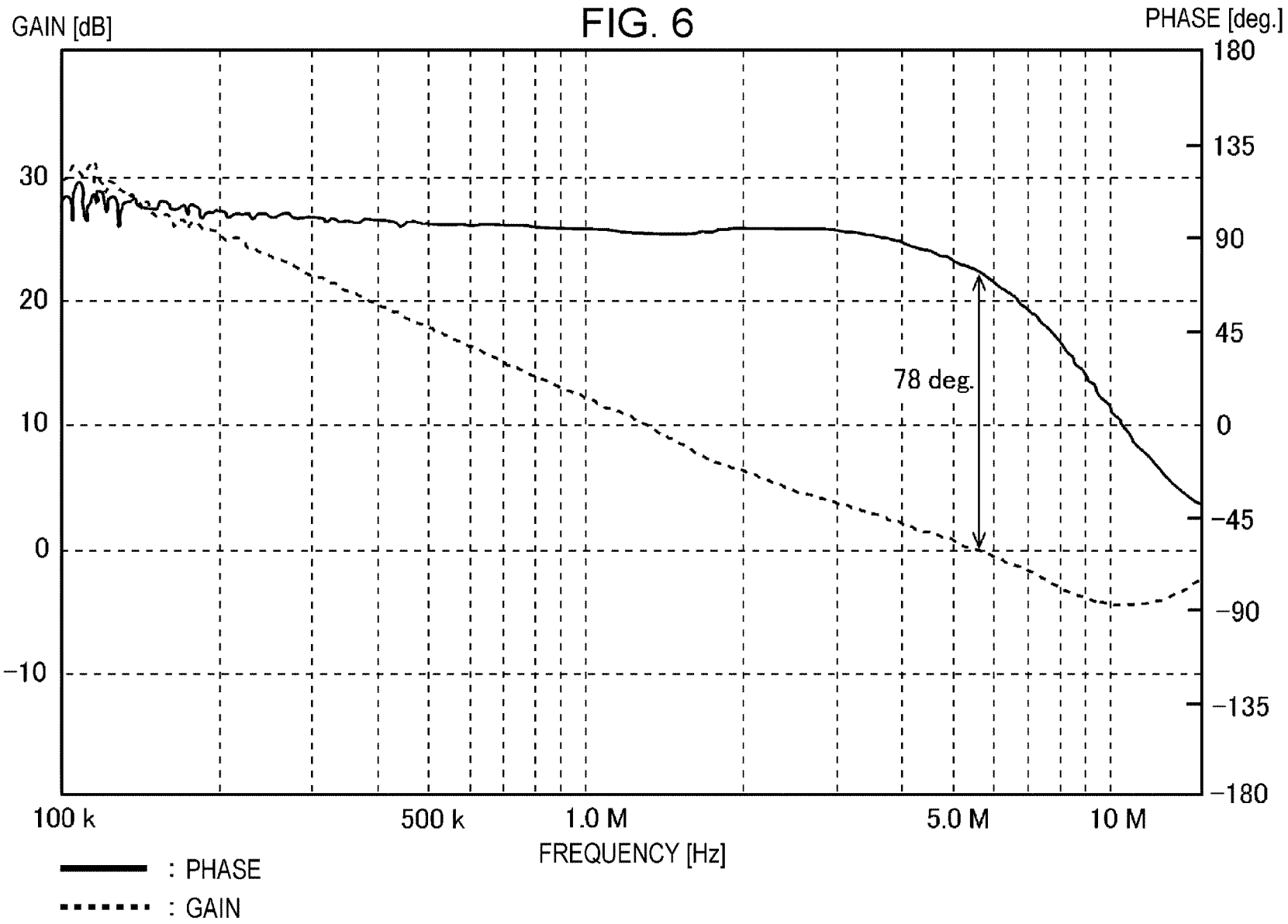
FIG. 6 is a graph illustrating gain-phase characteristics in the head driving circuit of the second embodiment.

FIG. 6 is a diagram illustrating the gain-phase characteristics of the head driving circuit 200B of this embodiment, in which the frequency characteristic of the phase is indicated by a solid line and the frequency characteristic of the gain is indicated by a broken line.

In the head driving circuit 200B of this embodiment, the coil L2 is inserted into the driving signal supply line L. Therefore, even in a case where the head driving circuit 200B and the printing head 170 are connected by the FFC 50 having a length of several meters or more, the frequency component near the resonance point of the LC resonance (near 5 MHz) configured in the FFC 50 can be suppressed. Therefore, a sharp change in phase can be suppressed and a phase margin can be secured. Therefore, the head driving circuit 200B can be stably operated. In particular, in this embodiment, as illustrated in FIG. 6, a phase margin of 78 degrees can be secured. In addition, the zero cross frequency is 5.0 MHz or more, and the ink discharge characteristics can be kept satisfactorily.

The embodiment described above is a preferred embodiment of the invention. However, the invention is not limited thereto, and various modifications can be made with the scope not departing from the gist of the invention.

For example, the functional blocks illustrated in FIG. 1, FIG. 2, and FIG. 5 are schematic diagrams illustrating the functional configuration of each device classified according to main processing contents so as to facilitate understanding of the invention. The configuration of each device can be classified into more constituent elements depending on the processing content. In addition, one constituent element can be classified to perform more processing. In addition, the processing of each constituent element may be executed by one piece of hardware or may be executed by a plurality of pieces of hardware. In addition, the processing of each constituent element may be realized by one program or may be realized by a plurality of programs.

In addition, for example, in the embodiment described above, the circuit configuration illustrated in FIGS. 2 and 5 is an example, and the configuration such as replacing the circuit elements illustrated in the drawing with the same number or different number of ICs can be changed, and the configuration can be arbitrarily changed within the scope of the invention.

What is claimed is:

1. A liquid discharge device comprising:

a liquid discharge head that has a nozzle which discharges liquid and a driving element which is provided corresponding to the nozzle and discharges the liquid by pressurizing the liquid according to a driving signal; and a driving circuit that is connected to the liquid discharge head via a cable and outputs the driving signal, wherein the driving circuit includes a signal output circuit which outputs an analog signal, a transistor pair which is connected to the signal output circuit and the cable and driven with the analog signal output from the signal output circuit to output the driving signal to the cable, a feedback loop which is connected to the cable and feeds back the driving signal output from the transistor pair to the signal output circuit, and an oscillation suppression circuit which suppresses oscillation of input from the feedback loop to the signal output circuit, the oscillation suppression circuit including an inductive element connected between the cable and the feedback loop.

2. The liquid discharge device according to claim 1, wherein the feedback loop includes a filter, as the oscillation suppression circuit, disposed between the cable and the signal output circuit.

3. The liquid discharge device according to claim 2, wherein the filter attenuates frequency components corresponding to the inductance and capacitance of the cable.

4. A printing apparatus comprising:

a printing head that has a nozzle which discharges ink and a driving element which is provided corresponding to the nozzle and discharges the ink by pressurizing the ink according to a driving signal; and a driving circuit that is connected to the printing head via a cable and outputs the driving signal, wherein the driving circuit includes a signal output circuit which outputs an analog signal, a transistor pair which is connected to the signal output circuit and the cable and driven with the analog signal output from the signal output circuit to output the driving signal to the cable, a feedback loop which is connected to the cable and feeds back the driving signal output from the transistor pair to the signal output circuit, and an oscillation suppression circuit which suppresses oscillation of input from the feedback loop to the signal output circuit, the oscillation suppression circuit including an inductive element connected between the cable and the feedback loop.

* * * * *